United States Patent [19]

Bolick, II et al.

[11] Patent Number: 4,892,636

[45] Date of Patent: Jan. 9, 1990

[54] MODULAR ELECTROLYTIC CELL AND PROCESSING APPARATUS

[75] Inventors: Roger E. Bolick, II, Chattanooga; David W. Cawlfield; Kenneth E. Woodard, Jr., both of Cleveland, all of Tenn.

[73] Assignee: Olin Corporation, Cheshire, Conn.

[21] Appl. No.: 207,798

[22] Filed: Jun. 17, 1988

[51] Int. Cl.[4] ..... C25B 9/00; C25B 15/08

[52] U.S. Cl. ..... 204/237; 204/241; 204/255; 204/256; 204/257; 204/258; 204/262; 204/271

[58] Field of Search ..... 204/237, 241, 252–258, 204/262–266, 271

[56] References Cited

U.S. PATENT DOCUMENTS

| | | | |
|---|---|---|---|
| 2,881,123 | 4/1959 | Zdansky | 204/256 |
| 4,153,532 | 5/1979 | Fitch et al. | 204/267 |
| 4,256,562 | 3/1981 | Mose et al. | 204/270 X |
| 4,285,786 | 8/1981 | Larson | 204/257 X |
| 4,378,286 | 3/1983 | Eng | 204/257 |

*Primary Examiner*—Donald R. Valentine

*Attorney, Agent, or Firm*—Ralph D'Alessandro

[57] ABSTRACT

An easily transportable electrolytic cell and associated processing apparatus is modularly constructed and supported in modular support sections that are easily separated and loaded onto transport vehicles for transport to distant remote sites where the electrolytic cell module and the processing apparatus module are reassembled and the apparatus is put into operation where the product chemical produced by the electrolytic cell is utilized.

31 Claims, 4 Drawing Sheets

MODULAR ELECTROLYTIC CELL AND PROCESSING APPARATUS

BACKGROUND OF THE INVENTION

This invention relates generally to the electrochemical manufacture of aqueous solutions of hydrosulfites. More particularly, the present invention relates to the modular electrolytic cell and processing apparatus that permit the cell to be easily transported to remote manufacturing locations.

The usual electrolytic production of electrochemicals is accomplished in large centralized facilities. This approach permits the costly capital plant to be installed at one location and the resources needed for the energy intensive manufacture to be delivered to the centralized site. Labor considerations are also economized by having production occur in one location and the product then shipped to using locations.

However, in some electrochemical manufacturing instances it is desirable to utilize off-site electrochemical production facilities at the location where the product chemical is used. This decentralization of the production facilities can prove economically disadvantageous if construction of the remote manufacturing facilities entail considerable costs. These costs can be minimized, however, if the production facilities can be constructed in a manner that permits them to be easily transported to the using site without the need for the expensive and time-consuming construction and costs that occur at the centralized facilities.

Filter press membrane cells have required the disassembly and removal of portions of the plural cell electrolyzer from a production line. This has led to the development of transfer parts to remove selected frames and assembly and disassembly technique to move the cell frames from an on-line position to an off-line position. Although the need to easily transport portions of the cell electrolyzer has been recognized, there has been no design to permit easy movement of the processing apparatus that accompanies the electrolytic cell. Accomodating this need is especially critical when electrochemical production facilities are to be constructed or positioned at remote sites where the chemical is utilized.

These needs are solved by the design of the electrolytic cell and its associated processing apparatus supported on modular support sections which are easily transported from the assembly location to the remote manufacturing location.

SUMMARY OF THE INVENTION

It is an object of the present invention to provide an easily transportable electrolytic cell and associated processing apparatus that may be assembled at a first location and transported long distances to remote sites where the electrochemical products are utilized.

It is a feature of the present invention that the electrolytic cell and its associated processing apparatus are supported on modular support sections that may easily be separated and loaded onto vehicles for transport to distant remote sites where the chemical is used.

It is another feature of the present invention that the electrolytic cell and its associated processing apparatus are easily separable.

It is advantage of the present invention that the electrolytic cell and its associated processing apparatus may be constructed and assembled at a first site, tested for proper operation, and then broken down and separated and easily transported to a distant remote using site.

It is another advantage of the present invention that the modular design permits low cost construction and an effective and reliable way of putting into operation an electrolytic cell and its associated processing apparatus at distant remote sites where the product chemical is used.

These and other objects, features and advantages of the invention are provided in the design of the electrolytic cell and processing apparatus that are supported on modular support sections that are easily loaded onto transport vehicles for transport to distant remote sites where the product chemical is utilized.

BRIEF DESCRIPTION OF THE DRAWINGS

The objects, features and advantages of the invention will become apparent upon consideration of the following detailed disclosure of the invention, especially when it is taken in conjunction with the accompanying drawings wherein.

DETAILED DESCRIPTION OF THE PREFERRED EMBODIMENT

Figure 1:
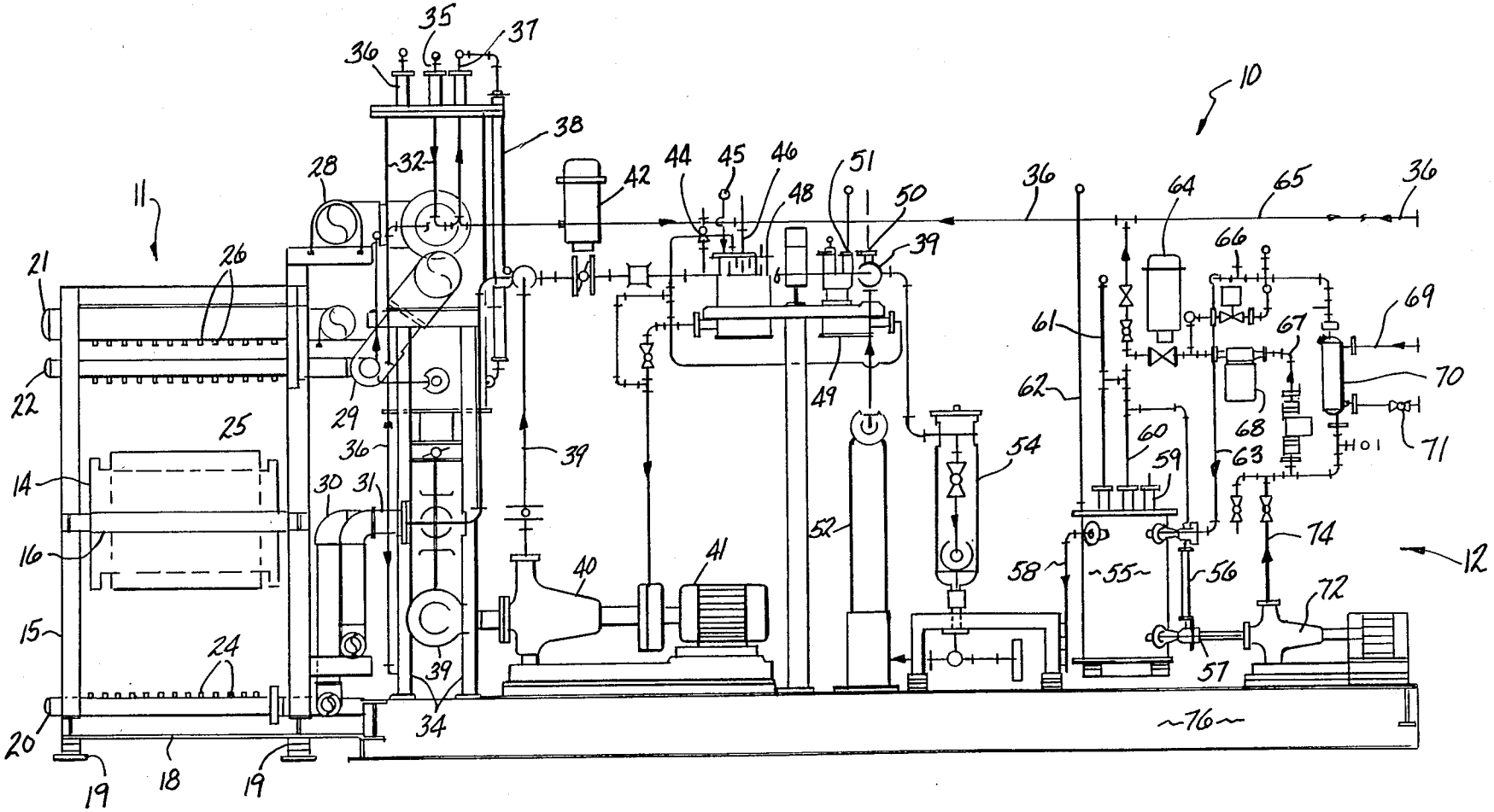
FIG. 1 is a side elevational view of the anolyte side of the electrolytic cell and the associated processing apparatus.

FIG. 1 shows in side perspective view the anolyte side of the electrolytic cell and accompanying processing apparatus, indicated generally by the numeral 10. The electrolytic cell apparatus is indicated generally by the numeral 11, while the associated processing apparatus is indicated generally by the numeral 12. Both the cell 11 and the processing apparatus 12 are in modular units.

The modular cell apparatus 11 consists of the filter press membrane electrolytic cell pack 14, which can consist of as many of fifteen or more bipolar electrodes assembled together, mounted and supported by vertical support frame members 15 and horizontal support frame members 16. The modular electrolytic cell apparatus 11 with its support frame members is mounted on a support skid 18 that is electrically isolated by insulators 19 between it and the ground. Although the electrolyte flow pipe tubing is not shown, an anolyte feed header 20 connects via the anolyte infeed pipes 24 to the bottom of the cell pack 14. Anolyte discharge header 21 is connected via the anolyte discharge header connections 26 and the flow pipe tubing (not shown) to the cell pack 14. A similar arrangement exists on the catholyte side. The corresponding catholyte structure can be seen in FIGS. 1 and 3, including the catholyte discharge header 22, the catholyte feed header (not shown), the catholyte feed pipe 31 and the catholyte discharge piping 29.

The specific structure and the flow patterns in the cell pack 14 that is found in the electrolytic cell module 11 is described in detail in U.S. Pat. No. 4,743,350 issued May 10, 1988 and assigned to the assignee of the present invention, and which is specifically incorporated herein by reference in pertinent part.

The cell module 11 is connected to the processing apparatus module 12 by various piping. On the anolyte side, as seen in FIG. 1, this includes anolyte discharge piping 28 and anolyte feed pipe 30. The anolyte is circulated through the anolyte system and the anolyte disengager 32 to the cell pack 14 via anolyte circulation line 39 and the forced circulation from anolyte circulation pump 40 and its associated pump motor 41. This processing equipment will be explained shortly.

The anolyte disengager 32 is seen having the anolyte discharge piping 28 connected thereto atop of anolyte disengager 32, which is also connected to an anolyte deionized water feed line 36, an anolyte caustic feed line 37, and anolyte level loop and gauge 38 and an anolyte oxygen vent 35, which passes into an anolyte seal pot 48. A deionized water feed line 45 and an oxygen vent 46 can be provided at that point. The anolyte passes out of the bottom of the disengager 32 into the anolyte circulation pump 40 and then is passed, still via the circulation line 39, to the anolyte flow control valve 42 and the anolyte pressure gauge 44. The anolyte exits the seal pot 48 and passes via the circulation line 39 into the anolyte filter 54, if utilized, and then is routed back through the multimeter 52 which measures the flow, temperature and density of the anolyte prior to its being passed back into the anolyte circulation pump 40. From the circulation pump 40 the anolyte is force circulated back into the anolyte feed pipe 30 and then through the previously described anolyte feed header 20 into the cell pack 14.

The processing apparatus module 12 includes all of the support equipment necessary to operate the electrolytic cell for the anolyte, catholyte and product systems, including the aforementioned anolyte disengager, circulation pump, piping and filters. The catholyte system also has corresponding equipment to the anolyte system in the processing module 12, as well as both systems having flow control valves and other instrumentation. A product and catholyte vent seal pot 49 with a nitrogen vent 50 and a water feed line 51 also can be seen in FIG. 1. Heat exchangers are utilized in the catholyte and product systems. All of this apparatus, as well as a product system apparatus, which will be discussed shortly, are mounted on a transportable processing support frame 76.

Figure 3:
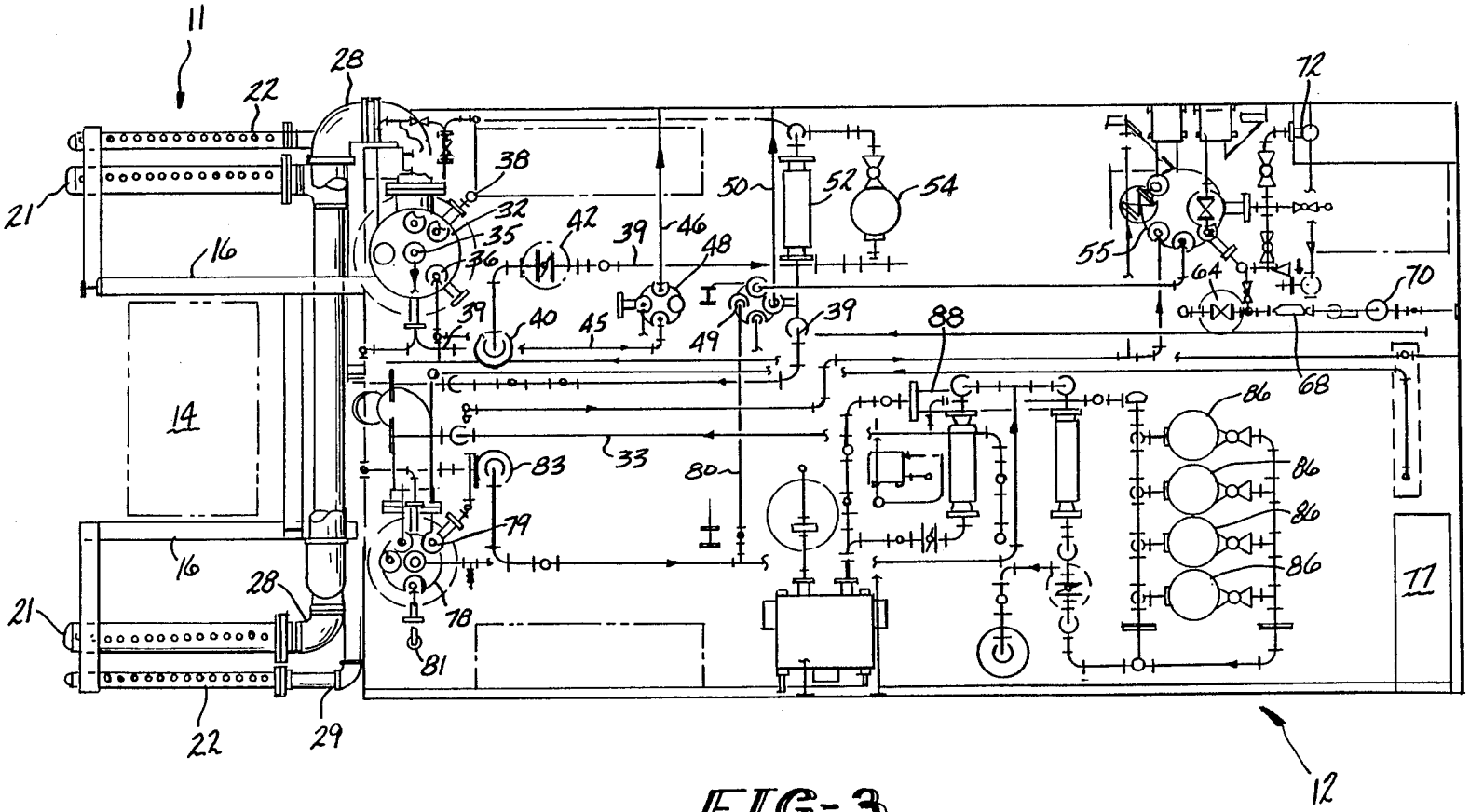
FIG. 3 is a top plan view of the electrolytic cell and associated processing apparatus.

The product storage system can also be partially seen in FIG. 1, as well as in FIG. 3. The product storage tank 55 receives the caustic feed through feed line 62, deionized water feed through water feed line 59, catholyte overflow through line 61, and has a vent and outlet line 60. The level in the storage tank 55 is measurable through the product tank level loop and gauge 56. A product overflow line 58 is provided to handle upset conditions. Product from the storage tank 55 flows through product pump feed line 57 The product circulation pump 72 circulates the product via product flow line 74 through a product heat exchanger or cooler 70, which is supplied with glycol refrigerant or coolant via a glycol supply line 69 and a glycol return line 71. Then the product passes from the cooler 70 through a conductivity meter 66 and returns to the product tank 55 via product circulation line 63. A product flow meter 68 on the product outlet loop 67 measures the product flow as it feeds into the product flow control valve 64 that controls the flow of product into the previously mentioned product outlet line 65 that carries the temperature controlled product to the permanent product storage tanks (not shown).

Also seen on the processing apparatus support frame 76 in FIG. 3 is an analog to digital conversion board station 77 for use in automatically controlling the process.

The electrolytic cell support skid 18 and the processing support apparatus frame 76 are formed from structural members, such as steel, fiberglass or other corrosion resistant and lightweight composite I-beams and channels. These members are either welded or bolted together to form the base of the cell apparatus module 11 and the processing apparatus module 12. Cross support members are provided on both modules as the supports for the major cell and processing apparatus, which may be welded or bolted thereto, as appropriate. Steel or fiberglass decking can be provided on the processing apparatus module 12 to facilitate maintenance and operator access. The modules 11 and 12 are connected only by the aforementioned piping that is easily connectable or separable by the use of flanges at the modules' interface.

Figure 2:
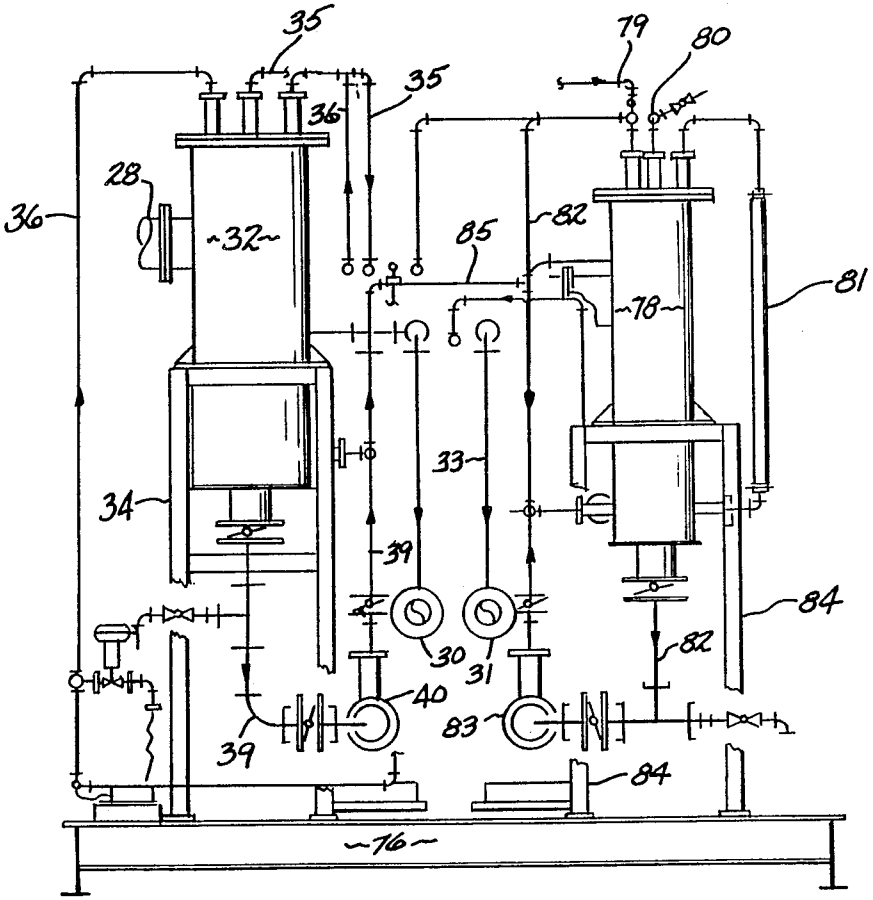
FIG. 2 is an end elevational view of the electrolytic cell's associated processing apparatus.

The catholyte system can be seen in FIGS. 1–3 in various views and completeness. A catholyte disengager 78 has a nitrogen infeed line 79, a hydrogen vent line 80 and a catholyte level loop and gauge line 81. The catholyte circulation line 82 feeds out of the bottom of the catholyte disengager 78 and flows into the catholyte circulation pump 83 which forces the catholyte about the circulation loop. The catholyte feed line 31 is shown connected to line 33, which ultimately feeds into the catholyte side of the cell pack 14 via the catholyte feed header (not shown).

As best seen in FIG. 3, the catholyte has $SO_2$ added through the static mixer 88 prior to being passed through the catholyte filters 86. The catholyte then is routed back to the cell pack 14 as described via line 33 and feed pipe 31.

Figure 4:
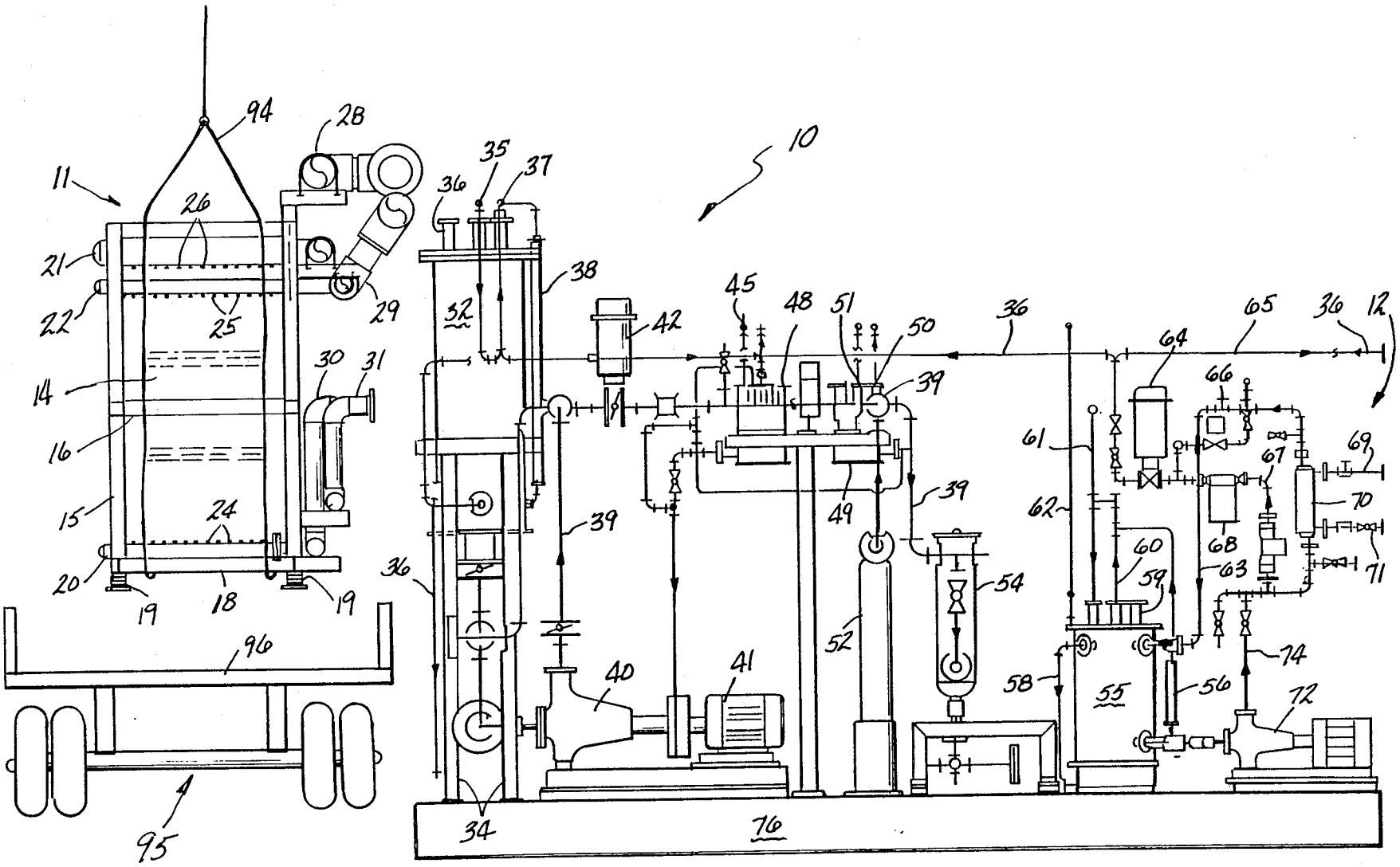
FIG. 4 is a side elevational view showing the modular cell section of the electrolytic cell being loaded onto a transport vehicle.

The electrolytic cell and processing apparatus 10 is built in a modular construction so that it may be assembled and tested at a first site and then disassembled and transported to a remote operating site. This disassembly and transport is made possible because of the modular concept employing the cell modular apparatus 11 and the processing apparatus module 12. This is best seen in FIG. 4 where the processing apparatus module 12 is shown in place on the ground while the cell module 11 is loaded via a crane sling 94 onto the bed 96 of a transport vehicle 95. This is accomplished by simply disconnecting the anolyte and catholyte feed pipes 30 and 31 at their flanges, the anolyte and catholyte discharge piping 28 and 29 at their flanges, and the interconnecting electrical lines. Once thus separated from the processing apparatus module 12, the cell module 11, having previously been drained and electrically disconnected, maybe slung loaded as indicated. The same procedure of draining and electrically disconnecting the apparatus on the processing apparatus module 12 is followed and module 12 is similarly slung loaded or forklift loaded onto a transport vehicle for transport to the remote site. Once on site, the cell apparatus module 11 and the processing apparatus 12 are positioned at their operating locations and reconnected. The modular concept for the electrolytic cell and processing apparatus 10 requires only that the rectifier, the raw materials storage tanks, the electrical switching gear, the deionizer for the deionized water supply, the refrigeration unit for the supply of glycol to the catholyte and the product cooling systems and the process control system be in place prior to delivery of the electrolytic cell and processing apparatus 10.

While the preferred structure in which the principles of the present invention have been incorporated as shown and described above, it is to be understood that the invention is not to be limited to the particular details and methods thus presented, but in fact, widely different means may be employed in the practice of the broader aspects of the invention. The scope of the appended claims is intended to encompass all obvious changes in the details, materials, and arrangement of the parts which will occur to one of skill in the art upon a reading of the disclosure.

Having thus described the invention, what is claimed is:

1. A modular electrolytic cell apparatus and processing apparatus for the electrolytic production of a chemical product, the modular cell and processing apparatus being easily assembled and disassembled for transport separately to a remote operating site, comprising in combination:

(a) generally horizontally positioned electrolytic cell support means defining the base of an electrolytic cell apparatus module;

(b) cell support structure means having generally vertically extending means connected to the generally horizontally positioned electrolytic cell support means;

(c) an electrolytic cell mounted to the cell support structure means;

(d) anolyte circulation means connected to the cell for supplying anolyte feed fluid to the electrolytic cell and for carrying anolyte fluid away therefrom;

(e) catholyte circulation means connected to the cell for supplying catholyte feed fluid to the electrolytic cell and for carrying catholyte fluid away therefrom, the electrolytic cell and the anolyte and catholyte circulation means being transportable as a separate assembled unit comprising the electrlytic cell apparatus module;

(f) generally horizontally positioned processing apparatus support means defining the base of the electrolytic cell processing apparatus module;

(g) an anolyte disengager mounted to the generally horizontally positioned processing apparatus support means and connectable to the anolyte circulation means;

(h) a catholyte disengager mounted to the generally horizontally positioned processing apparatus and connectable to the catholyte circulation means;

(i) anolyte processing circulation means connected in fluid flow communication with the anolyte disengager for transporting anolyte through the processing apparatus and mounted to the processing apparatus support means;

(j) catholyte processing circulation means connected in fluid flow communication with the catholyte disengager for transporting catholyte through the processing apparatus and mounted to the processing apparatus support means;

(k) anolyte pump means mounted to the processing apparatus support means and connected to the anolyte processing circulation means for continuously circulating the anolyte therethrough between the electrolytic cell and the processing apparatus;

(l) catholyte pump means mounted to the processing apparatus support means and connected to the catholyte processing circulation means for continuously circulating the catholyte therethrough between the electrolytic cell and the processing apparatus; and (m) control means for controlling the flow of anolyte fluid and catholyte fluid through the processing apparatus, the processing apparatus mounted to the processing apparatus support means being transportable as a separate assembled unit comprising the processing apparatus module.

2. The apparatus according to claim 1 wherein the electrolytic cell support means further comprises cross supports to which the cell support structure means are connected.

3. The apparatus according to claim 2 wherein the cell apparatus module is transportable separately from the electrolytic cell processing apparatus module.

4. The apparatus according to claim 3 wherein the electrolytic cell support means are a plurality of electrically isolated beams that form an independent and free-standing module.

5. The apparatus according to claim 4 wherein the cell support structure means further comprises a plurality of connected horizontal and vertical support members.

6. The apparatus according to claim 5 wherein the processing apparatus support means further comprise cross support means to which is connected the processing apparatus.

7. The apparatus according to claim 1 wherein the electrolytic cell is a filter press membrane cell.

8. The apparatus according to claim 7 wherein the chemical product is an aqueous alkali metal hydrosulfite.

9. The apparatus according to claim 8 wherein the electrolytic cell processing apparatus further comprises cooling apparatus to control the temperature of the aqueous alkali metal hydrosulfite.

10. The apparatus according to claim 9 wherein the electrolytic cell processing apparatus further comprises a product storage tank.

11. The apparatus according to claim 10 wherein the electrolytic cell processing apparatus further includes a sulfur dioxide supply line and a static mixer connected to the catholyte processing circulation means.

12. The apparatus according to claim 11 wherein the electrolytic cell processing apparatus further comprises deionized water feed lines connected to the anolyte disengager and the catholyte disengager.

13. The apparatus according to claim 12 wherein the electrolytic cell processing apparatus further comprises caustic feed lines connected to the anolyte disengager and the product storage tank.

14. A modular electrolytic filter press membrane cell apparatus and processing apparatus for the electrolytic production of a aqueous alkali metal hydrosulfite, the modular cell and processing apparatus being easily assembled and disassembled for transport separately to a remote operating site, comprising in combination:

(a) generally horizontally positioned electrolytic cell support means defining the base of an electrolytic cell apparatus module;

(b) cell support structure means having generally vertically extending means connected to the generally horizontally positioned electrolytic cell support means;

(c) an electrolytic cell mounted to the cell support structure means;

(d) anolyte circulation means connected to the cell for supplying anolyte feed fluid to the electrolytic cell for carrying anolyte fluid away therefrom;

(e) catholyte circulation means connected to the cell for supplying catholyte feed fluid to the electrolytic cell and for carrying catholyte fluid away therefrom;

(f) generally horizontally positioned processing apparatus support means defining the base of the electrolytic cell processing apparatus module;

(g) an anolyte disengager connected to the generally horizontally positioned support means and connectable to the anolyte circulation means;

(h) a catholyte disengager connected to the generally horizontally positioned processing apparatus and connectable to the catholyte circulation means;

(i) anolyte processing circulation means connected in fluid flow communication with the anolyte disengager for transporting anolyte through the processing apparatus;

(j) catholyte processing circulation means connected in fluid flow communication with the catholyte disengager for transporting catholyte through the processing apparatus;

(k) anolyte pump means connected to the anolyte processing circulation means for continuously circulating the anolyte therethrough between the electrolytic cell and the processing apparatus;

(l) catholyte pump means connected to the catholyte processing circulation means for continuously circulating the catholyte therethrough between the electrolytic cell and the processing apparatus;

(m) cooling apparatus at least partially mounted to the processing apparatus support means to control the temperature of the aqueous alkali metal hydrosulfite;

(n) a product storage tank mounted to the processing apparatus support means;

(o) a sulfur dioxide supply line and a static mixer mounted to the processing apparatus support means and connected to the catholyte processing circulation means; and (p) control means for controlling the flow of anolyte fluid and catholyte fluid through the processing apparatus.

15. The apparatus according to claim 14 wherein the electrolytic cell support means further comprises cross supports to which the cell support structure means are connected.

16. The apparatus according to claim 15 wherein the cell apparatus module is transportable separately from the electrolytic cell processing apparatus module.

17. The apparatus according to claim 16 wherein the electrolytic cell support means are a plurality of electrically isolated beams that form an independent and free-standing module.

18. The apparatus according to claim 17 wherein the cell support structure means further comprises a plurality of connected horizontal and vertical support members.

19. The apparatus according to claim 18 wherein the processing apparatus support means further comprise cross support means to which is connected the processing apparatus.

20. The apparatus according to claim 19 wherein the electrolytic cell processing apparatus further comprises deionized water feed lines connected to the anolyte disengager and the catholyte disengager.

21. The apparatus according to claim 20 wherein the electrolytic cell processing apparatus further comprises caustic feed lines connected to the anolyte disengager and the product storage tank.

22. In an electrolytic cell system having processing apparatus for the electrolytic production of a chemical product, the improvement comprising:

(a) an electrolytic cell apparatus module comprising a generally horizontally positioned electrlytic cell support means to which are mounted an electrolytic cell and anolyte and catholyte circulation means connected to the cell, the electrolytic cell apparatus module being transportable as a separate assembled unit; and (b) a processing apparatus module connectable to the electrolytic cell apparatus module at least partially comprising a generally horizontally positioned processing apparatus support means, anolyte and catholyte disengagers, anolyte and catholyte processing circulation means to transport the anolyte and catholyte between the cell and the processing apparatus, anolyte and catholyte pump means to continuously circulate the anolyte and the catholyte through the anolyte and catholyte processing circulation means and control means to control the flow of anolyte and catholyte fluid through the processing apparatus, the processing apparatus module being transportable as a separate assembled unit.

23. The apparatus according to claim 22 wherein the electrolytic cell support means further comprises cross supports to which the cell support structure means are connected.

24. The apparatus according to claim 23 wherein the electrolytic cell support means are a plurality of electrically isolated beams that form an independent and free-standing module.

25. The apparatus according to claim 24 wherein the processing apparatus support means further comprise cross support means to which is connected the processing apparatus.

26. The apparatus according to claim 22 wherein the electrolytic cell is a filter press membrane cell.

27. The apparatus according to claim 26 wherein the chemical product is an aqueous alkali metal hydrosulfite.

28. The apparatus according to claim 27 wherein the processing apparatus module further comprises a product storage tank.

29. The apparatus according to claim 28 wherein the processing apparatus module further includes a sulfur dioxide supply line and a static mixer connected to the catholyte processing circulation means.

30. The apparatus according to claim 29 wherein the processing apparatus module further comprises deionized water feed lines connected to the anolyte disengager and the catholyte disengager.

31. The apparatus according to claim 30 wherein the processing apparatus module further comprises caustic feed lines connected to the anolyte disengager and the product storage tank.

* * * * *